US009874063B2

(12) United States Patent
Arian et al.

(10) Patent No.: US 9,874,063 B2
(45) Date of Patent: Jan. 23, 2018

(54) APPARATUS AND METHOD FOR STORING CORE SAMPLES AT HIGH PRESSURE

(71) Applicant: Halliburton Energy Services, Inc., Houston, TX (US)

(72) Inventors: Abbas Arian, Houston, TX (US); Bruce Mackay, Missouri City, TX (US); Michael Pelletier, Houston, TX (US); Michael Malone, Tomball, TX (US); Wade Samec, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 370 days.

(21) Appl. No.: 14/369,543

(22) PCT Filed: Dec. 21, 2012

(86) PCT No.: PCT/US2012/071129

§ 371 (c)(1),
(2) Date: Jun. 27, 2014

(87) PCT Pub. No.: WO2013/101695

PCT Pub. Date: Jul. 4, 2013

(65) Prior Publication Data

US 2014/0367086 A1 Dec. 18, 2014

Related U.S. Application Data

(60) Provisional application No. 61/582,068, filed on Dec. 30, 2011.

(51) Int. Cl.
*E21B 25/08* (2006.01)
*E21B 27/00* (2006.01)
(Continued)

(52) U.S. Cl.
CPC ..... *E21B 25/08* (2013.01); *E21B 25/00* (2013.01); *E21B 27/00* (2013.01); *E21B 49/06* (2013.01)

(58) Field of Classification Search
CPC ..... E21B 49/06; E21B 25/02; E21B 25/10; E21B 25/08
See application file for complete search history.

(56) References Cited

U.S. PATENT DOCUMENTS 6,216,804 B1 * 4/2001 Aumann ..... E21B 25/08 175/17
7,500,388 B2 * 3/2009 Fujisawa ..... E21B 49/06 73/152.11

(Continued)

OTHER PUBLICATIONS

International Search Report and Written Opinion issued in related International Application No. PCT/US2012/071129 dated Jan. 16, 2014, 10 pages.

*Primary Examiner* — Shane Bomar
(74) *Attorney, Agent, or Firm* — Scott Richardson; Baker Botts L.L.P.

(57) ABSTRACT

A sampling tool to sample core samples from a wellbore is disclosed. A core sampling storage module includes a pressure housing to store a plurality of core samples, a core tube within the pressure housing, the core tube to store a plurality of core samples drilled from a downhole formation, a pressure housing cover that is configured to be selectively rotated to an open position or a closed position, an activation mechanism to receive a command, and based on the command, open or close the pressure housing cover, a push rod to selectively install a plug to cover the core tube, wherein when the plug is installed the pressure housing maintains a pressure.

17 Claims, 8 Drawing Sheets

(51) Int. Cl.
*E21B 49/06* (2006.01)
*E21B 25/00* (2006.01)

(56) References Cited

U.S. PATENT DOCUMENTS

| | | | | |
|---|---|---|---|---|
| 7,748,265 | B2 | 7/2010 | Reid et al. | |
| 8,430,186 | B2 * | 4/2013 | Reid, Jr. | E21B 49/06 175/239 |
| 2008/0066534 | A1 * | 3/2008 | Reid | E21B 49/06 73/152.11 |
| 2010/0282515 | A1 | 11/2010 | Reid, Jr. | |
| 2011/0242938 | A1 * | 10/2011 | Garcia-Osuna | E21B 49/06 367/86 |
| 2012/0012393 | A1 * | 1/2012 | Kumar | E21B 25/00 175/58 |
| 2012/0111635 | A1 * | 5/2012 | Caffell | E21B 10/02 175/58 |
| 2012/0305317 | A1 * | 12/2012 | Riboldi | B66D 1/56 175/57 |
| 2016/0273292 | A1 * | 9/2016 | Morgan | E21B 25/10 |
| 2016/0376861 | A1 * | 12/2016 | Westacott | E21B 25/02 175/58 |

* cited by examiner

APPARATUS AND METHOD FOR STORING CORE SAMPLES AT HIGH PRESSURE

CROSS-REFERENCE TO RELATED APPLICATION

This application is a U.S. National Stage Application of International Application No. PCT/US2012/071129 filed Dec. 21, 2012, which claims priority to U.S. Provisional Patent Application No. 61/582,068 filed Dec. 30, 2011, both of which are hereby incorporated by reference in their entirety.

BACKGROUND

The present invention relates to the collection of core samples and, more particularly, to apparatuses and methods for improved core sampling.

FIGURES

Some specific exemplary embodiments of the disclosure may be understood by referring, in part, to the following description and the accompanying drawings.

Figure 3A:
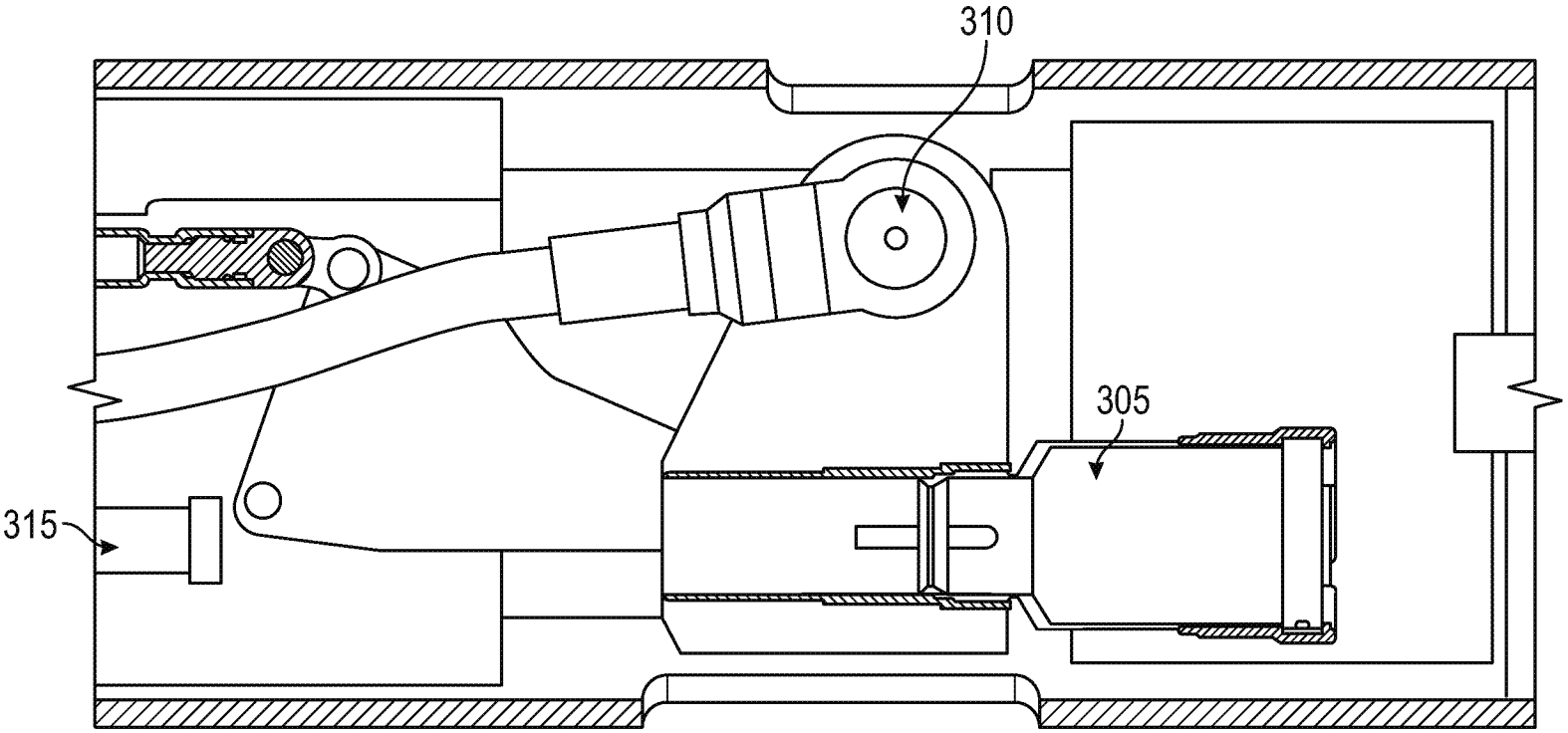
Figure 3B:
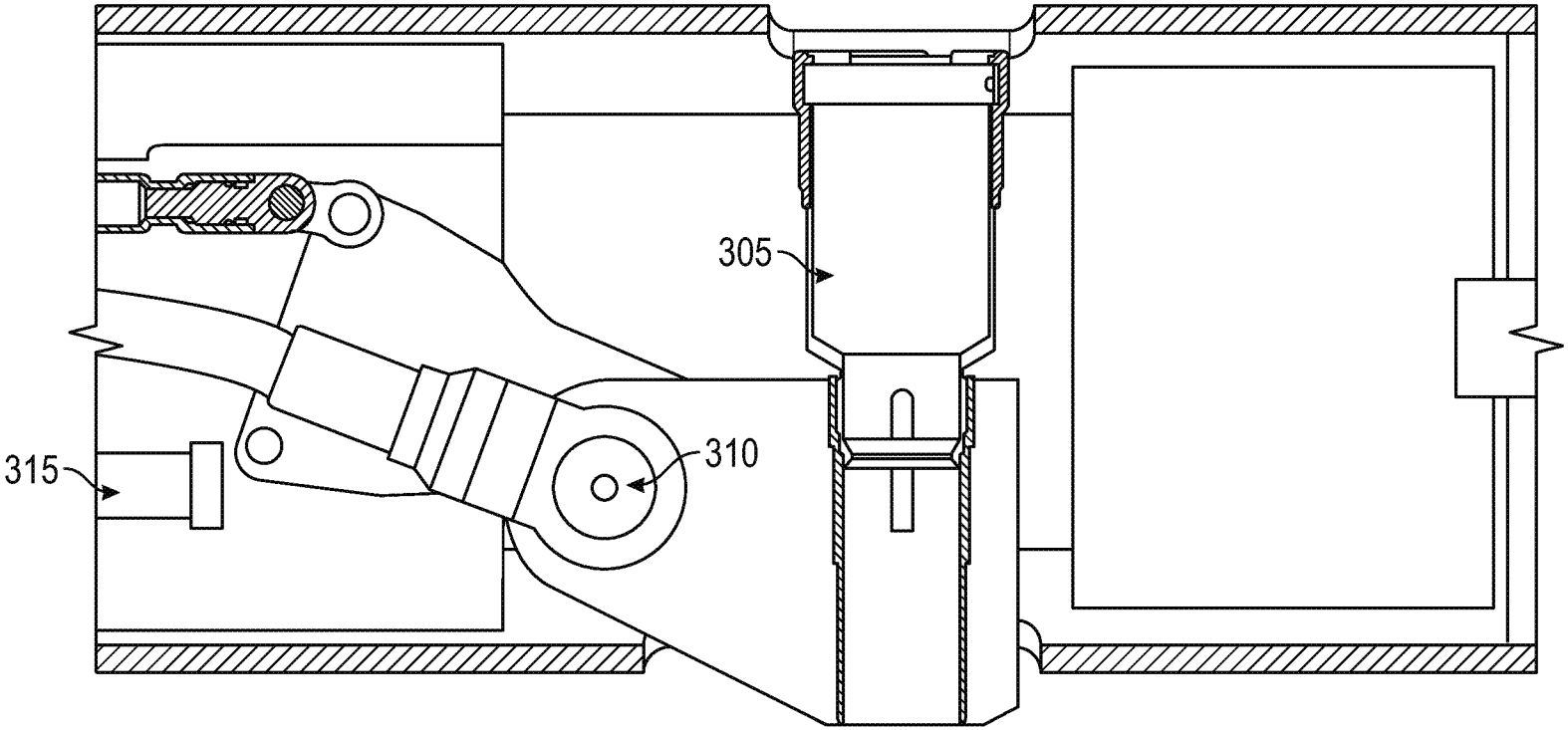
Figure 3C:
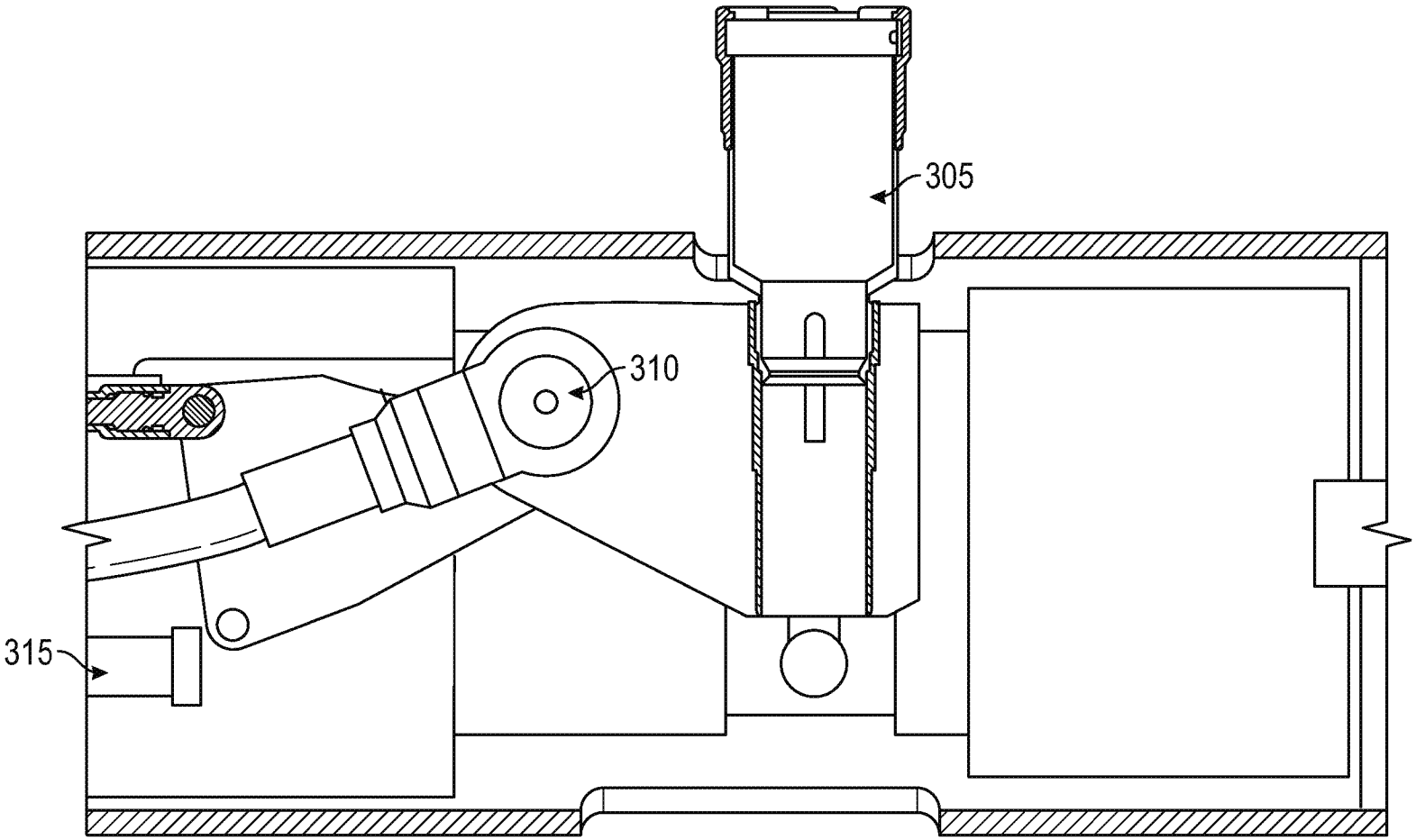

FIGS. 3A, 3B, and 3C are cut-away views of the core drilling portion of an example sidewall drilling tool.

Figure 4:
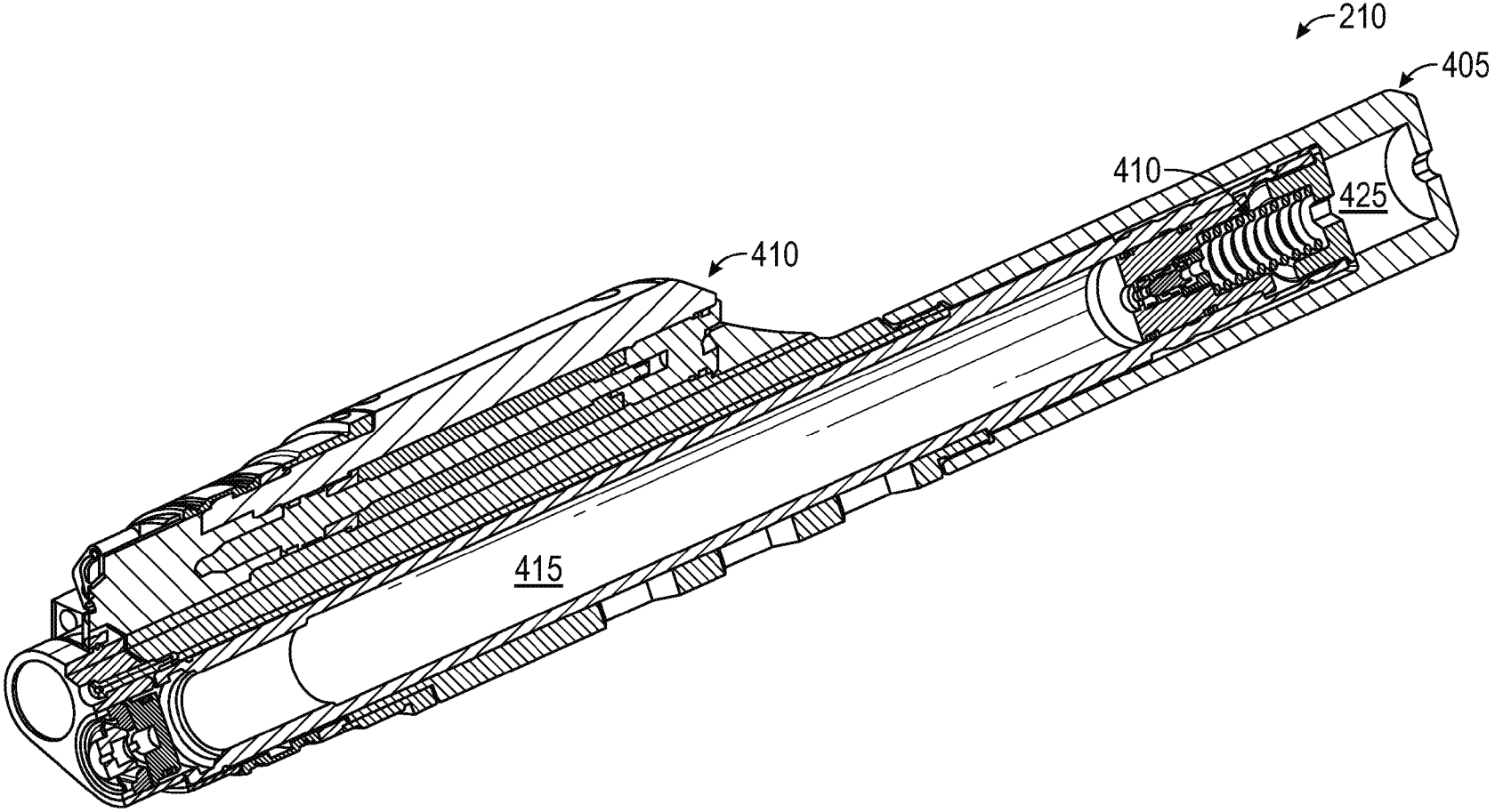
Figure 6:
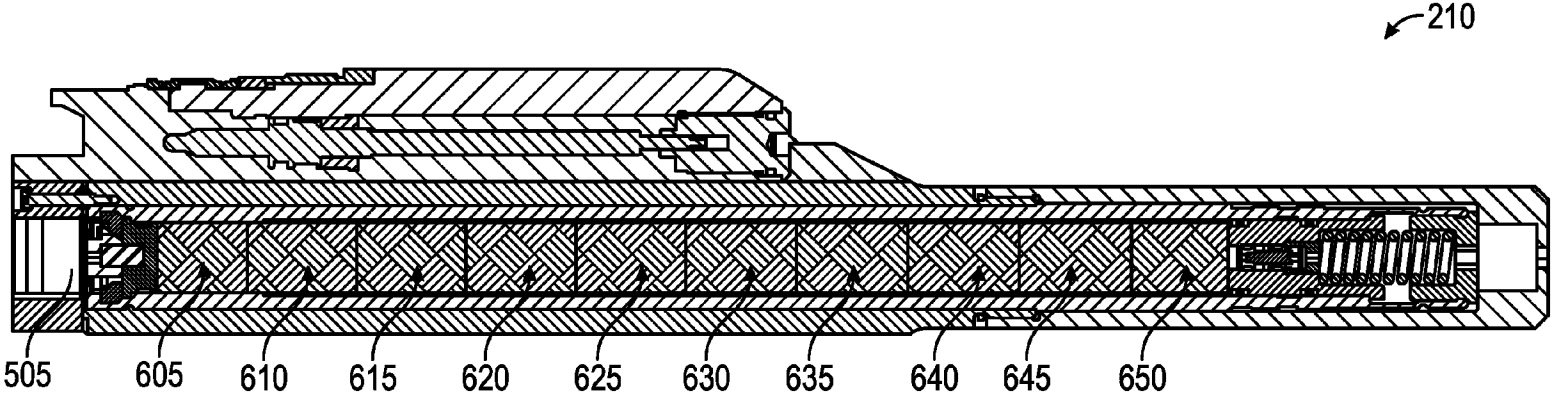

FIGS. 4 and 6 are cut-away views of an example high-pressure core module according to the present disclosure.

Figure 5:
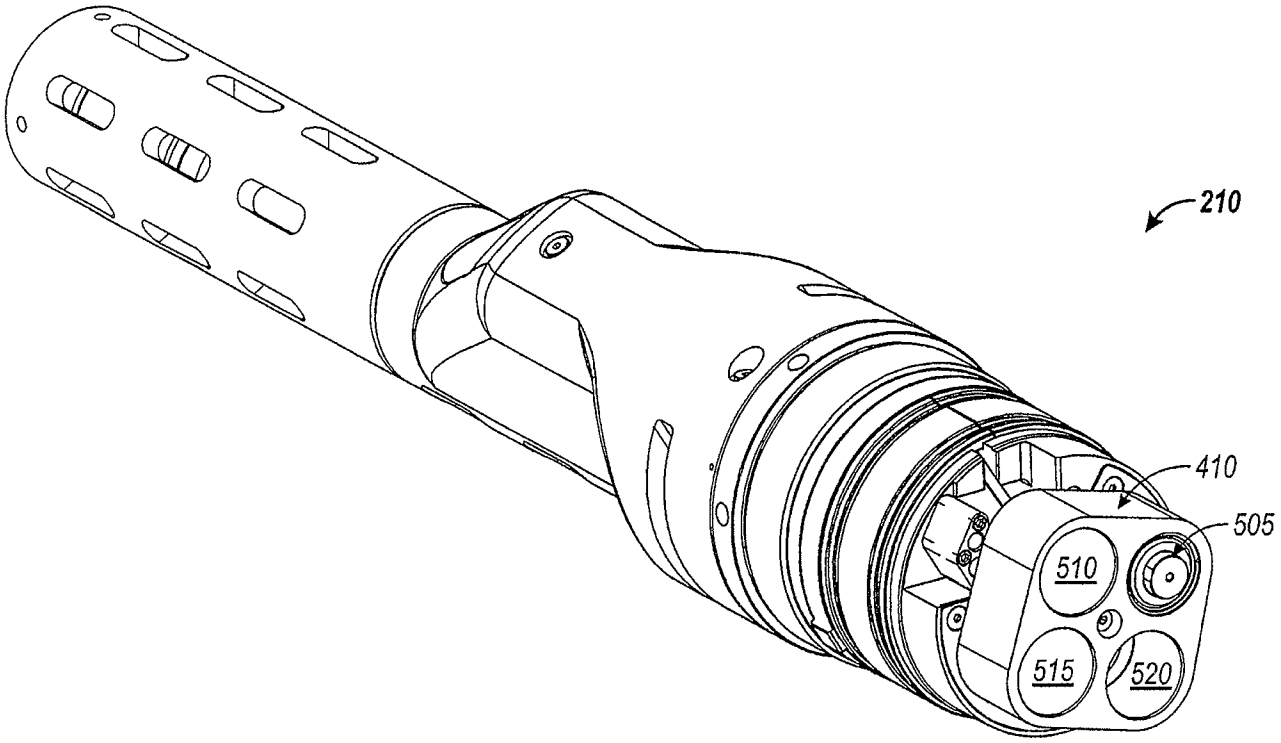

FIG. 5 is an elevation view of an example high-pressure core module according to the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates to testing and evaluation of subterranean formation fluids and, more particularly, to apparatuses and methods for improved core sampling.

Illustrative embodiments of the present invention are described in detail herein. In the interest of clarity, not all features of an actual implementation may be described in this specification. It will, of course, be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Figure 1:
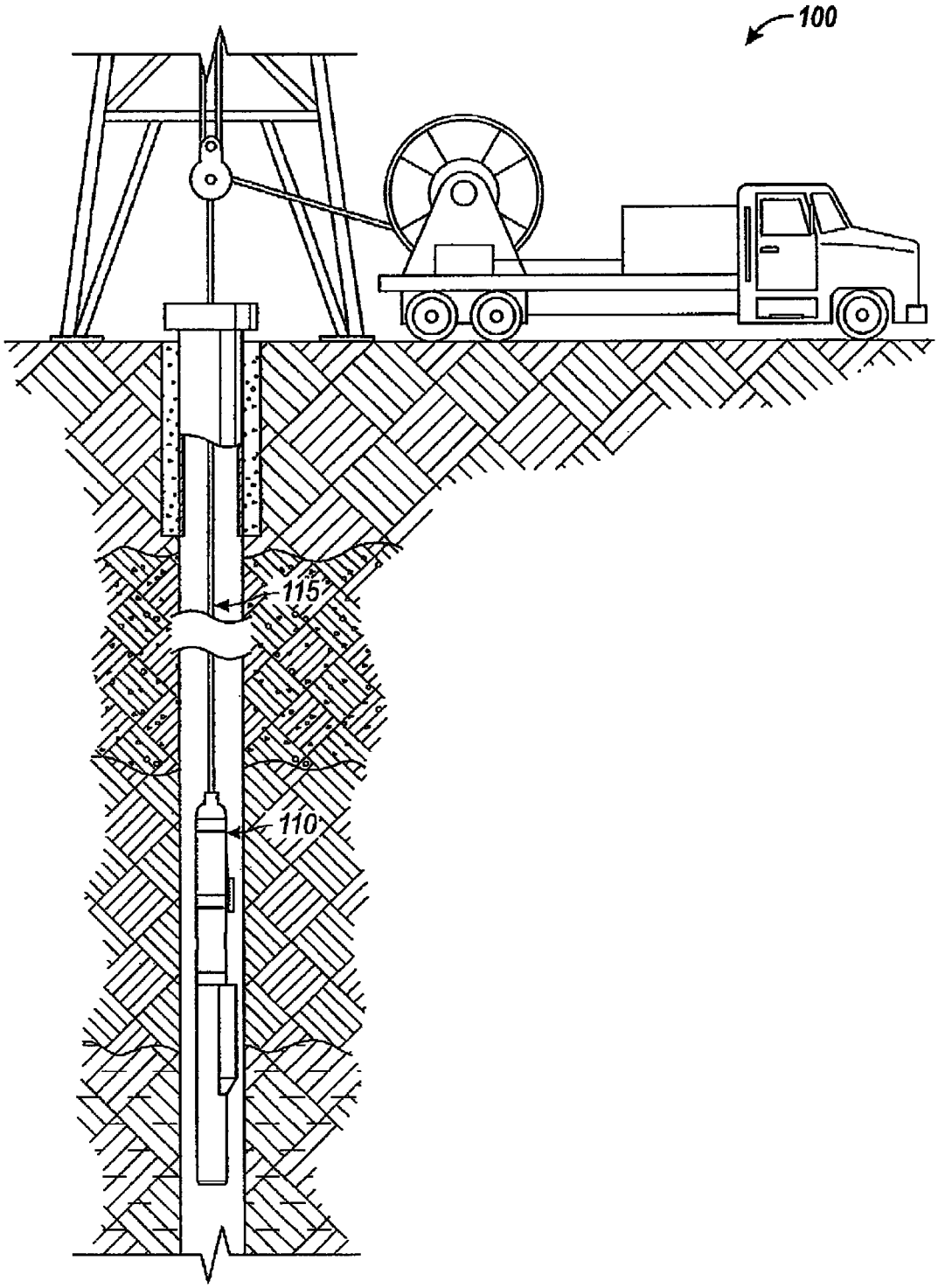
FIG. 1 is an example wireline implementation of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented in which the tool is made suitable for testing, retrieval and sampling along sections of the formation. Embodiments may be implemented with various samplers that, for example, may be conveyed through flow passage in tubular string or using a wireline, slickline, coiled tubing, downhole robot or the like. The system of present disclosure may be suited for use with a modular downhole formation testing tool, such as the Reservoir Description Tool (RDT) by Halliburton, for example. Devices and methods in accordance with certain embodiments may be used in one or more of wireline, measurement-while-drilling (MWD) and logging-while-drilling (LWD) operations FIG. 1 shows an example system 100 of the present disclosure. In the example shown in FIG. 1, tool 110 is placed in a wellbore by wireline 115. In certain example embodiments, tool 110 is placed in wellbore by wired coil tubing. In other example embodiments, tool 110 is placed in the borehole as part of a measurement while drilling (MWD) portion of a drillstring or as part of a logging while drilling (LWD) portion of a drillstring. In other example implementations, the tool 110 may be on a drillpipe as part of a wired drillpipe system.

Figure 2:
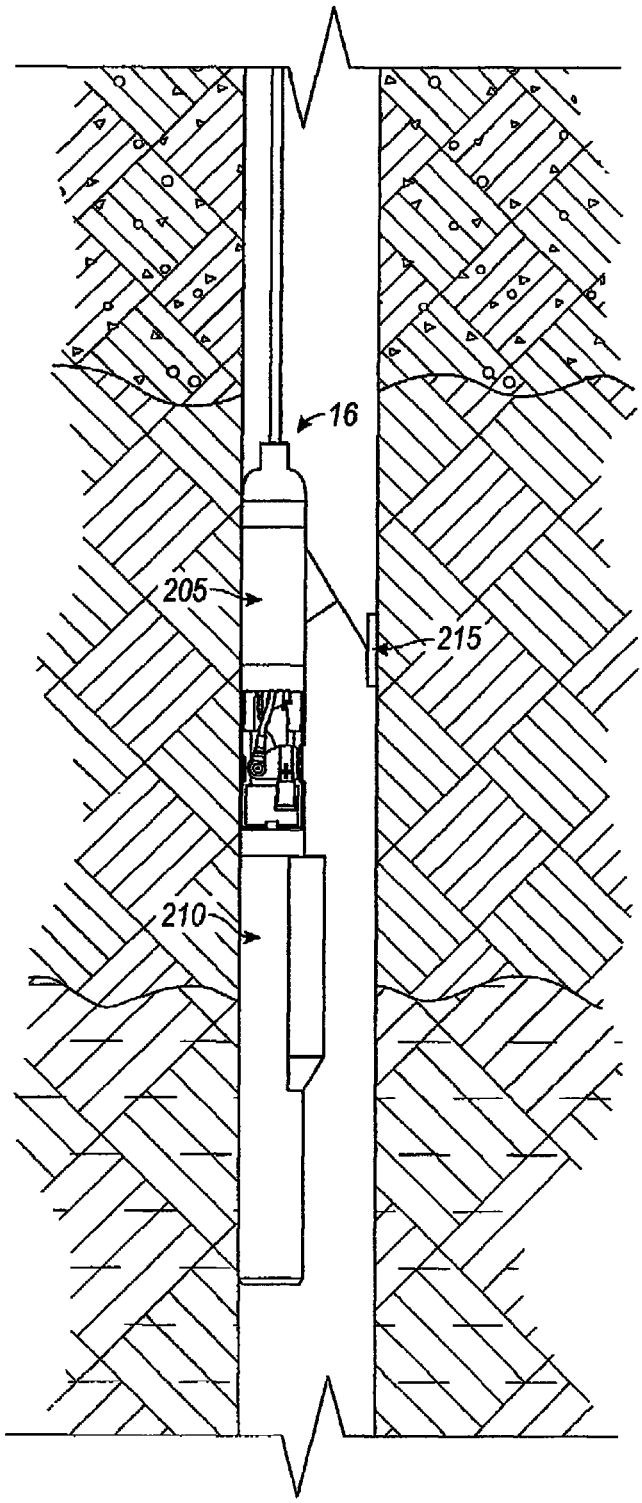
FIG. 2 is an example implementation of the tools of the present disclosure at a downhole location.

FIG. 2 shows an example tool 110 that has been lowered to a depth of interest. The example tool 110 includes a sidewall drilling tool 205 and a High Pressure (HP) core module 210. Once the tool 110 is in a region of interest the sidewall drilling tool 205 extends a stabilizing pad 215 against the wall of the borehole and rotates the core drilling tool to face the wellbore wall.

FIGS. 3A, 3B, and 3C show an example core drilling portion of the sidewall drilling tool 205. The core drilling portion includes a coring bit 305 to be forced into a formation and collect a core sample. Certain example coring bits 305 include a finger in the coring head to retain a sample. The example core drilling portion includes a bell crank 310 allowing the coring bit to be both rotated and moved. As shown in FIGS. 3A-C the coring bit 305 is spun while it is translation into the wall of the wellbore. In certain implementations, the core sample is cut from the wellbore until the tool has reached a maximum displacement into the wellbore all. In certain implementations, a sharp lateral translation of the tool and core barrel assembly will break the core sample free from the formation wall. In certain implementations, the sequence of FIGS. 3A-C is reversed as the coring bit 305 is retracted back into the tool and then rotated parallel to the tool. In certain implantations, the coring it is aligned with the HP core module 210. The core is pushed into the core receiver of the HP core module 210 by, for example, plunger 315.

FIG. 4 shows an example HP core module 210. The HP core module 210 includes a HP core tube assembly 405, which, in turn, includes a carrier chamber 415 to store a plurality of core samples. The HP core tube assembly further includes a cover activation mechanism 410 to open and close the opening to the carrier chamber 415. The example HP core module 210 includes a chemical chamber 425 for storing one or more chemicals for use with core samples.

In certain example embodiments, the HP core module 210 is a standalone assembly for use with an existing sidewall coring tool. The HP core module 210 is configured to store the cores after they are retrieved from the formation by a side wall coring tool, such as the sidewall drilling tool 205. The cores are stored within the carrier chamber 415 of the HP core module. In one example embodiment, the sidewall coring tool 205 may be a Hostile Rotary Sidewall Coring (HRSCT) tool. In one example embodiment, the HP core module includes two sections. The first section is an activation mechanism module 410 and the second section is a HP core tube assembly module 405.

Turning to FIG. 5, an example cover activation mechanism 410 is shown from outside the tool. The example cover activation mechanism 410 may be actuated to place one of a cover 505 or the contents of one of chambers 510, 515, or 520 in front of the HP core module 210. Other example HP core modules 210 may include fewer than four chambers, while other example HP core module 210 include four, five, six, seven, eight, nine, ten, or more chambers. Example ones of chambers 510, 515, and 520 may include one or more of isolator plugs, packaging film, or other items for preserving core samples. Example cover activation mechanisms 410 are actuated by a rotational motor, which may be a geared motor or a servo. Other example cover activation mechanisms 410 are actuated by a cable with a spring.

In certain example embodiments, when the tool is in coring mode, a mechanism rotates the cover to the open position which allows the sampled core to be deposited into the core tube 415 of the HP core tube assembly module 215. In one example embodiment, after each core is drilled and deposited in the core tube 415, the mechanism rotates the cover to the closed position 410. Once in closed position, if the push rod command is activated, the push rod can install a plug 505 through the cover into the HP core tube 415. The plug 505 may maintain the pressure of the HP core tube 415, for example, while it is brought to the surface and transported to a laboratory for testing. Once on the surface, the core tube assembly 415 can be removed from the larger assembly and shipped to the lab for further evaluation and testing.

In certain example embodiments, the core sampler obtains two or more sets of core samples from different formation regions in a single run and stores the sets of core samples in the HP core tube 415. Example embodiments use, for example, swellable packers to isolate the sets of core samples from each other in the HP core tube 415. In other example implementations, the cores are separated with a disc. Example discs are composed of compliant materials, such as foam. Certain example discs seal against the walls of the core tube assembly to isolate the core samples and prevent fluid from being transferred between core samples. Example discs may help to prevent the core samples from rattling in the core tube and breaking while in transit to surface or in transit to the lab. Example discs are used to identify from what location a core sample was take. This may be useful, for example, if the core samples are soft or unconsolidated. Example discs seal chemically to deter the adsorption of mud component or gas exposure.

Example HP core tube assemblies 405 include one or more sensors. Certain example sensors are located at the top and others may be located at the bottom of the core tube 415. The sensors may measure one or more of temperature, pressure, or acceleration. The one or more sensors may be coupled with a memory to store logged data. In certain example embodiments the memory is capable of being queried and read at the surface.

In certain embodiments, the plugging of the HP core tube 415 is performed after the desired core samples are retrieved and deposited in the HP core tube 415. In certain example implementations, the plugging of the HP core tube 415 maintains the pressure of the core samples while the HP core tube assembly is brought to the surface and after the HP core tube assembly has been brought to the surface. For example, the pressure may be maintained at or near in-situ pressure for the formation samples.

In certain example implementations, the HP core tube assembly 405 further includes one or more heaters to apply heat to the core samples. In certain example implementations, the heaters are controlled based, at least in part, on one or more temperature measurements in the HP core tube assembly 210. Certain example implementations include one or more heaters at one or both ends of the HP core tube 415. Other example implementations include one or more heaters along at least part of the length of the HP core tube 415. For example, the HP core tube assembly 205 may include a thin-film heater along at least part of its length to heat core samples.

Certain example implementations of the HP core tube assembly 210 may maintain both the pressure and the temperature of a core sample. In these implementations, gasses within the core sample may be kept in solution after the HP core tube 415 is brought to the surface.

In certain example implementations the HP core tube assembly 210 includes one or more sensors to measure one or more of temperatures, pressure, or acceleration. In certain implementations, one or more sensors are located at or near the top of the HP core tube 415 and one or more sensors are located at or near the bottom of the HP core tube 415. The sensors are connected to a memory to store one or more measurements from the sensors. The memory is further coupled to one or more processors to control the measurements from the sensors and the storage of the measurements in the memory. In certain example embodiments, the sensors measure one or more of a temperature, a pressure, or an acceleration during or after storing a core sample in the HP core tube assembly 210. The system may further store a time associated with the sampling of a core and associate the time with the measured temperature, pressure, or an acceleration. In certain implementations, the memory may be queried using a computer and a wired or wireless connection to the processor of the HP core tube assembly 210.

In certain example implementations, the system may log one or more properties before, during, or after the sampling. The system may include a data logger including one or more processors and a memory for storing instructions for the one or more processors and logged data. In certain implementations, the system logs data measured, including, for example pressure, temperature, or acceleration data. For example, in certain implementation, the system may continue to log acceleration after sampling and after the HP core tube 415 is brought to the surface. In some implementations, the system may continue to sample and record acceleration while the HP core tube 415 is transported to a location for testing. In this way, it may be possible to determine whether the HP core tube 415 was handled in a way that is compatible with reliable testing of core samples. If the HP core tube 415 is exposed to excessive acceleration during handling or transport, the sampled cores within the HP core tube 415 may be damaged. By using acceleration data stored in the memory of the HP core tube 415, potential damage to the sampled cores can be identified and a corresponding time may be determined. Using this data, certain implementations allow a user to determine whether, when, and in whose custody a core may have been damaged.

Certain example implementations are configured to record a core sample breaking due to residual stress. In some implementations, based on the sensitivity of the accelerometers, the time frequency of micro creaking of the cores is used to determine the remaining residual stress in the core sample.

The ability of the HP core tube assembly to log and report measured acceleration may be used as a tool for improving operations that can impact the quality of core samples. For example, the effectiveness of one or more of winching operations, one or more wall impacts, near surface depressurization, thermal stresses, lubricator operations, took break down, surface transportation, and storage may be evaluated based on data sensed and recorded in the memory of the HP core tube assembly.

In certain example implementations, the temperatures and pressures measured and recorded are used to generate data required in coal systems to generate gas desorption curves. In such an implementation, the samples as required are part of an experiment ready sample cartridge for methane desorption testing.

Certain example implementations of the HP core tube assembly include a carrier chamber 415 filled with a fluid such as nitrogen. In some implementations, the bottom of the sample tube is fitted with a piston 420 which is compressed as core samples are loaded into the sample tube. In one example implementations, as a core sample is loaded the HP core tube assembly 205 is secured on top and a piston 420 is energized to maintain an axial load on the core samples. In certain implementations, the piston 420 is a traveling piston or a floating piston. In such an implementation, an axial load is maintained on the core samples as they are brought to the surface from the pressure maintained by the travel piston.

In other example implementations, the HP core tube assembly 210 includes a bladder in the wall of the HP core tube 415. In these implementations, the bladder wall is used to maintain an axial load on the core samples, maintaining hydrostatic pressure in the core samples. This bladder wall may help to preserve strain state of the core sample. The bladder wall may further help to prevent shifting of the core samples during transport and maintain gas phase of the core samples.

In certain implementations, the HP core tube assembly 205 further includes tubing material to receive one or more core samples in the HP core tube 415. For example a thermoplastic such as polyether ether ketone (PEEK) or Teflon may be used as a tubing in the HP core tube 415. In one implantation, the tubing is arranged like a "sock" with the open end attached to the closed end of the HP core tube 415. In one implementations, as a core sample is brought into the HP core tube 415, it is encased in a portion of the tubing. In certain implementations, a heater is used to heat shrink a portion of the tubing around the core sample. In some implementations, the shrinking and application of a constricting radial load from the tubing seals the core sample. This application of the tubing material may further help to reduce the amount of mud in contact with the core sample. In some implementations, this heat shrink sealing helps to retain liquids in the core sample and may further help to prevent sample-to-sample contamination. In certain implementations where the core samples are stored in tubing material, after a sample is loaded, a sample retainer is rotated once as a sample tamping piston is nearing contact. This seals each of the tubing-material sheathed core samples in an individual compartment.

Other example HP core tube assemblies 205 feature the ability to displace drilling mud present in the sampling chamber before it is sealed. In certain implementations, the samples are installed in the close fitting storage and transport barrel of the HP core tube 415 and a sample port at the bottom of the system is opened injecting an expanding sealant. As the sealant expands, mud is displaced and a skin coats the cores. This skin of sealant may help to prevent damage to the core samples during the trip to the top of the well and beyond. The sealant may further help to keep fluids in the core samples. In certain implementations, the expanding sealant is a two-part urethane foam. Example sealing foams may further include one or more chemical tracers. The tracers may be used to gauge pore space infusion or fluid contamination of the core samples. In certain implementations, the interior of the HP core tube 415 is coated to allow the sealant-coated core samples to be removed with the fluid saturations of the core samples intact.

Still other example HP core tube assemblies 205 include a sampling chamber with end caps and fittings suitable for installation in laboratory displacement apparatus. In one example HP core tube assembly 205, the core samples are stored continuously in a tube lined system where core end plate with flow fittings is attached to the end of the tube. In one example implementation, the tube lining is Teflon. In another example implementation, the tube line in PEEK. In example operation, the core samples are installed in the receiving chamber and a top cap is forced into place as the tube is heat sealed to the top cap. In certain example implementations, the top cap is fitted for laboratory studies, such as flow studies where fluid is flowed into or out of the sampling chamber. In some implementations, one or both of axial and radial loads are maintained on the core samples, using techniques described above. Alternatively, one end cap is set to stroke with hydraulic pressure, while the radial component is maintained though a side port though which fluid is injected to maintain the core samples under compression while the samples are conveyed to the surface. In some implementations, a hydraulic support system maintains the stress condition on the core samples after retrieval, and during transportation of the core samples in the sampling chamber to, for example, a laboratory. The radial and axial loads may further be maintained while the sample chamber is installed in lab equipment.

FIG. 6 show a HP core tube assembly 205 where the HP core tube 415 is filled with sampled cores 605-650 and cap 505 has been fitted over HP core tube 415.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A core sampling storage module comprising:

a pressure housing to store a plurality of core samples;

a core tube within the pressure housing, the core tube to store a plurality of core samples drilled from a downhole formation and wherein the core tube has a single open end;

a pressure housing cover that is configured to be selectively rotated to an open position or a closed position;

an activation mechanism to receive a command, and based on the command, open the pressure house cover in response to a command to open the pressure housing cover and further to close the pressure housing cover in response to a command to close the pressure housing cover; and a push rod to selectively install a plug to cover the core tube, wherein when the plug is installed the pressure housing maintains a pressure.

2. The core sampling storage module of claim 1, further comprising: one or more heaters to apply heat to core samples in the core tube.

3. The core sampling storage module of claim 1, further comprising:

one or more sensors configured to measure one or more of a temperature, a pressure, and an acceleration in a location of the core tube;

a memory to store one or more measured temperatures, pressures, and accelerations; and a processor to receive a measurement from the one or more sensors and store the measurement from the one or more sensors in the memory.

4. The core sampling storage module of claim 1, further comprising:

a plurality of disks to sealingly engage the walls of the core tube and separate core samples.

5. The core sampling storage module of claim 1, further comprising:

a tubing to encase one or more core samples, wherein the tubing has a single open end;

a heater to heat at least a portion of the tubing, causing the tubing to conform to one core sample; and a tamping piston to seal the tubing around each core sample.

6. The core sampling storage module of claim 5, wherein the tubing is polytetrafluoroethylene (PTFE).

7. The core sampling storage module of claim 5, wherein the tubing is polyether ether ketone (PEEK).

8. The core sampling storage module of claim 5, wherein the tubing is polyether ether ketone (PEEK).

9. The core sampling storage module of claim 1, further comprising:

a piston at the bottom of the core tube to maintain an axial load on the one or more core samples in the core tube.

10. The core sampling storage module of claim 1, further comprising:

a bladder in the core tube to maintain a hydrostatic pressure on one or more core samples, wherein the bladder is selectively inflated.

11. The core sampling storage module of claim 1, wherein the core tube is at least partially filled with nitrogen.

12. A method of sampling a plurality of sidewall core samples, the method comprising:

cutting a plurality of core sample from the sidewall of a well, wherein at least two of the core samples are from different locations in the well;

opening a pressure housing cover from a core tube to allow the core tube to be loaded with one or more core samples;

loading the core samples in the core tube within a pressure housing;

after the core samples are loaded in the core tube, plugging the core tube to maintain a pressure in the core tube; and bringing the core samples to the surface.

13. The method of claim 12, further comprising:

at least partially separating one or more core samples using a disc in the core tube.

14. The method of claim 12, further comprising:

heating the core samples in the core tube to maintain the core samples at a desired temperature.

15. The method of claim 12, further comprising:

measuring one or more of temperature, pressure, or acceleration of the core tube; and logging the measured temperature, pressure, or acceleration in a memory.

16. The method of claim 15, further comprising:

querying the memory to determine whether the core tube experienced excessive acceleration; and determining when the core tube experienced the excessive acceleration.

17. The method of claim 12, further comprising:

encasing one or more core samples in a tubing.

* * * * *